United States Patent [19]

Rudeen

[11] Patent Number: 4,876,950

[45] Date of Patent: Oct. 31, 1989

[54] ROOF VENTILATOR

[76] Inventor: Richard D. Rudeen, 4008 Roanoke Cir. North, Golden Valley, Minn. 55422

[21] Appl. No.: 182,460

[22] Filed: Apr. 18, 1988

[51] Int. Cl.[4] ..... F24F 7/02

[52] U.S. Cl. ..... 98/42.21; 98/42.01; 52/199

[58] Field of Search ..... 98/42.01, 42.2, 42.21, 98/42.22; 52/199

[56] References Cited

U.S. PATENT DOCUMENTS

| | | | |
|---|---|---|---|
| Re. 31,849 | 3/1985 | Klein | 55/389 |
| 3,236,170 | 2/1966 | Meyer et al. | 98/42.21 |
| 3,625,134 | 12/1971 | Smith | 98/42.21 |
| 3,949,657 | 4/1976 | Sells | 98/42.21 |
| 4,231,768 | 11/1980 | Seibert et al. | 55/179 |
| 4,325,290 | 4/1982 | Wolfert | 98/42.21 |

FOREIGN PATENT DOCUMENTS

| | | | |
|---|---|---|---|
| 2356782 | 5/1975 | Fed. Rep. of Germany | 98/42.21 |

*Primary Examiner*—Harold Joyce

*Attorney, Agent, or Firm*—Peterson, Wicks, Nemer & Kamrath

[57] ABSTRACT

The roof ventilator includes a membrane of closed cell plastic so that it is rendered impervious to moisture and a pair of laterally-spaced open cell plastic strips adhesively secured to one side of the membrane, the strips being of foamed polyurethane. Specifically, the strips have a multiplicity of intercommunicating cells or pores so that when installed air can readily flow outwardly through the interconnected cells of the strips, yet inward migration of moisture is inhibited by reason of the many interlinked filaments or strands that form the various cells. The roof ventilator can be attched to a conventional roof by means of nails or an adhesive.

9 Claims, 3 Drawing Sheets

ROOF VENTILATOR

BACKGROUND OF THE INVENTION

1. Field of the Invention

This invention relates generally to roof ventilators, and pertains more particularly to a low profile structure comprised of an impervious membrane having laterally-spaced open cell strips secured thereto.

2. Description of the Prior Art

The patent literature is replete with various constructions for passively promoting the ventilation of attics and the like having sloping roofs. Typical of such ventilators are U.S. Pat. 3,185,070 for "Roof Ridge Ventilator" granted to Lester L. Smith on May 25, 1965; U.S. Pat. 3,236,170 for "Ventilated Roof Construction" granted on Feb. 22, 1966 to Melancthon H. Meyer, et al; U.S. Pat. 3,949,657 for "Ventilated Cap for the Ridge of a Roof" granted on Apr. 13, 1976 to Gary L. Sells; U.S. Pat. 4,325,290 for "Filtered Roof Ridge Ventilator" granted to Clarke K. Wolfert on Apr. 20, 1982; and U.S. Pat. 4,676,147 for "Roof Ridge Ventilator" granted to James P. Mankowski on June 30, 1987.

Basically, the patented constructions in my opinion function satisfactorily. Nonetheless, in general, prior art ventilators, including to some degree those disclosed in the above-identified patents, possess certain shortcomings, such as being costly, unsightly, somewhat difficult to install, requiring undue maintenance, excessive restriction to airflow, and failure to adequately inhibit the migration of moisture.

SUMMARY OF THE INVENTION

Accordingly, one object of the present invention is to enhance the outward flow of air from the region beneath a roof and at the same time inhibit the inward passage of moisture and insects. In this regard, an aim of the invention is to provide a non-porous membrane to which are adhesively attached a pair of laterally-spaced open cell strips having a multiplicity of interconnected pores so that air can freely flow outwardly therethrough while the entrance of moisture and insects in a reverse direction is inhibited by the myriad of interlinked strands forming the various pores or open cells. Stated somewhat differently, it is within the purview of the invention to provide a multiplicity of interconnected cell or pores so that a maximum airflow is achieved and at the same time an optimum restriction to moisture and insects in a reverse direction is realized even when the moisture is in the form of wind-driven rain.

Another object of my invention is to provide a ventilator for use on the ridges of sloping roofs, the ventilator having a very low profile so that it will be aesthetically pleasing, actually being hardly noticeable from the ground.

An important practical advantage of my invention stemming from the provision of a low profile ventilator is that exterior air currents caused by even severe wind conditions are laminarly deflected over the ventilator, thereby further inhibiting any inward passage of moisture.

Also, the invention has for an object the avoidance of external baffles, although such baffles may be employed if desired.

Another object is to provide a roof ventilator that can be fabricated of a suitably colored plastic so as to blend in or even match the color of the adjacent roof shingles.

However, my roof ventilator permits the attaching of overlying shingles if desired.

Yet another object of the invention is to provide a roof ventilator that is readily conformable to the slope of the roof to which it is attached. In this regard, it is also an aim of the invention to eliminate the need for cant strips on steeper pitch roofs.

Also, the invention has for an object the fabrication of the ventilator in sections of predetermined length, yet enabling any section to be cut to a lesser length during installation, such as when the last section must be shortened so as to coincide with one end of the roof.

Further, an object of the invention is to permit the individual ventilator sections to be butt-sealed together, either by using an adhesive or heat.

Another object of the invention is to provide an inexpensive roof ventilator, one that will be virtually maintenance-free.

Briefly, my invention envisages a roof ventilator comprised of a relatively thin, flexible membrane that is impervious to wind and moisture. A pair of laterally-spaced open cell strips are attached to what constitutes the lower side of the membrane when installed, the cells or pores thereof being interconnected so that a free flow of air can pass therethrough from the region beneath the roof having my ventilator installed thereon. The filaments or strands forming the cells or pores serve as a barrier to any reverse flow of moisture or insects into the space beneath the roof. My ventilator can be either nailed or adhesively attached to the roof. After my ventilator is secured in place, overlying shingles can be attached, the same nails anchoring the ventilator to the roof also securing the overlying shingles in place or the shingles may be adhesively secured to the ventilator.

DESCRIPTION OF THE PREFERRED EMBODIMENT

Figure 1:
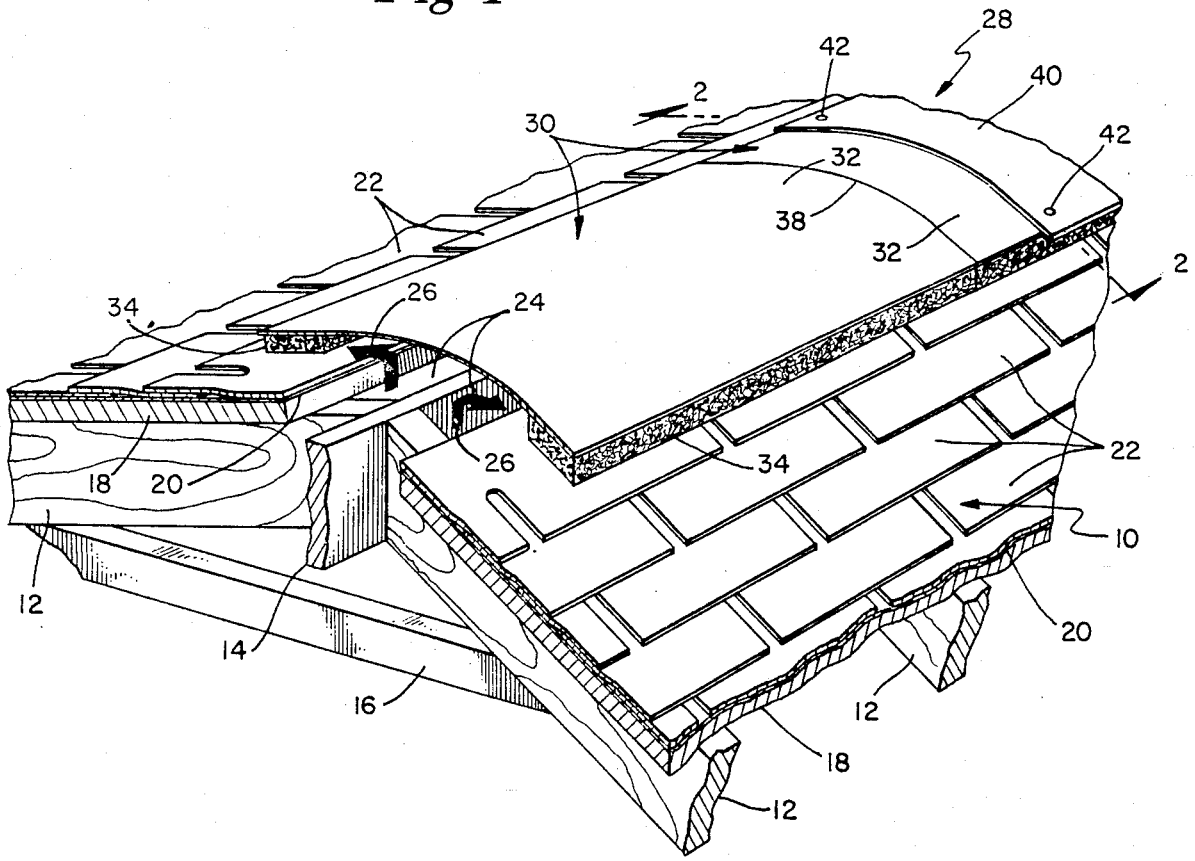
FIG. 1 is a perspective view having my roof ventilator installed thereon, the view showing a portion of a shingle overlying one of the ventilator sections in this instance.

Although my invention is intended for use with conventional sloping roofs, it will perhaps be well to describe such a roof. With this in mind, a portion of a typical roof has been labelled 10 which includes rafters 12 in the illustrated situation with a ridge pole 14 placed between the upper ends of the rafters 12 plus a collar beam 16 extending horizontally between each pair of rafters. However, some roofs employ a truss construction not requiring a ridge pole. Sheathing 18 overlies the rafters 12 and over the sheathing 18 is a layer of felt or building paper 20. Some roof shingles 22 have been illustrated which are nailed to the sheathing 18, the nails passing through the felt 20 which overlies the sheathing 18. A vent opening 24 permits the upward and outward flow of air in the direction of the arrows 26 from the region beneath the roof 10, such as an attic. It will be appreciated, although not illustrated, that various vents in the lower portion of the attic permit the ingress of air so that the normal flow is upwardly and outwardly through the vent opening 24, as indicated by the arrows 26.

It is planned that m roof ventilator denoted y generally by the reference numeral 28 will be fabricated in predetermined lengths, such as eight-foot or ten-foot long sections. One such section which has been inverted in FIG. 6, has been designated generally by the reference numeral 30. It can be pointed out that the width of the section 30 is on the order of one foot, whereas its thickness is slightly more than one inch. Each section of the overall ventilator 28 includes a plastic membrane 32 having a thickness on the order of three-sixteenths inch. This membrane is impervious to the passage of air and moisture: specifically, it is formed from a closed-cell foam plastic, such as polypropylene. The membrane 32 is lightweight and flexible. Its density is on the order of three pounds per cubic foot. The membrane 32 is sufficiently flexible so that it readily conforms to the slope or pitch of the roof as can be seen from FIGS. 2 and 5.

Playing an important role in the practicing of my invention are two plastic strips 34 that are laterally spaced with respect to each other so as to provide an intermediate space labelled 36. Unlike the plastic membrane 32, the strips 34 are of open cell foamed plastic having a multiplicity of interlinked filaments or strands that are quite slender or skeletal as far as their cross section is concerned. To proportionally picture such strands would require a macroscopic view that would serve no useful purpose.

It is important to understand that the multiplicity of filaments or strands provide a myriad of interconnecting cells or pores. The open cell plastic material forming the strips 34 is preferably foamed polyurethane having a density on the order of 1.75 pounds per cubic foot, such as P20 filter foam supplied by Illbruck USA Inc., Minneapolis, Minn. 55412. It will be understood that the foaming process forms the various filaments and the cells therebetween. What should be appreciated is that the interconnected cells or pores permit virtually an unrestricted flow of air to occur with the open cells in the most preferred form actually constituting about 95% of the overall cross section of each strip 34. In this way, air can flow freely through the cells or pores, yet the interlinked filaments or strands provide an effective barrier that inhibits the inward movement of moisture or insects.

An appropriate adhesive permanently attaches each of the strips 34 to one side of the membrane 32. The permanently attached strips 34 form a space 36 therebetween. Thus, the ventilator section 30 is truly a unitary structure.

Specifically, the strips 34 have a width of two inches and a thickness of seven-eighth inch. With the membrane 32 possessing a thickness of three-sixteenth inch, the combined thickness of both the membrane 32 and strips 34 constitutes one and one-sixteenth inch. This is important in providing a low profile when the sections 30 are mounted on the ridge of the roof 10.

Although the method of mounting or installing the various ventilator sections 30 to form the assembled ventilator 28 will presently be described, attention is directed at this stage to the abutting of adjacent sections 30 in an end-to-end relationship and the heat sealing or cementing thereof together, the resulting joint having been given the reference numeral 38.

Figure 2:
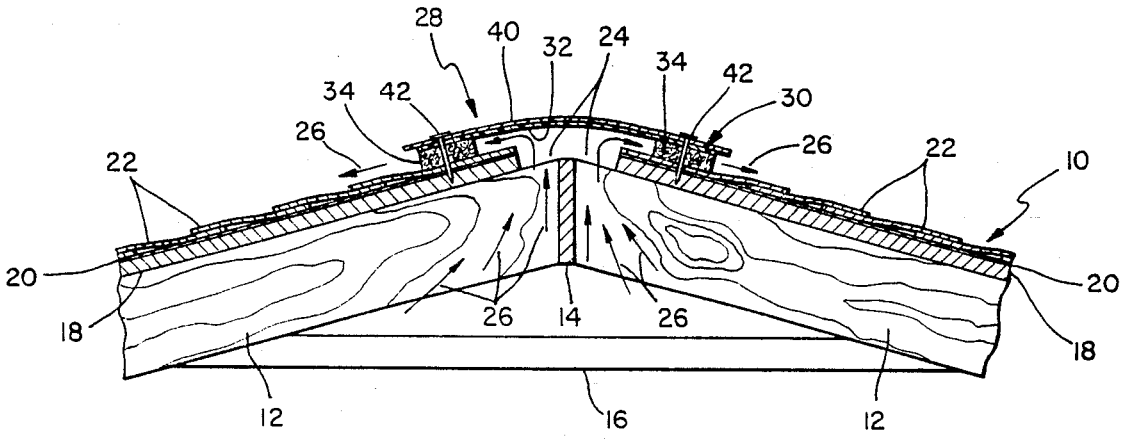
FIG. 2 is a sectional view taken in the direction of line 2—2 of FIG. 1, the view showing the use of nails that serve the dual purpose of anchoring my ventilator in place and also securing the depicted shingle to the upper side of the ventilator.

Demonstrating the versatility of my roof ventilator 28, it will be pointed out that it lends itself readily to having overlying shingles 40 attached thereto by reason of nails 42, two of which appear in FIGS. 1 and 2. When employing the nails 42, and it will be appreciated that any suitable number can be used, the roofer would first tack a particular section 30 in place by driving a nail or two downwardly through the membrane 32, through one or both of the strips 34, through the underlying shingles 22 and building paper 20 into the sheathing 18. If desired, a suitable adhesive may be employed instead of the nails used for tacking. After this, the overlying shingles 40 are placed on top of the membrane 32 and the additional nails 42 are driven downwardly through the overlying shingles 40, the membrane 32, the strips 34, the paper 20 and the shingles 22 into the underlying sheathing 18.

Figure 5:
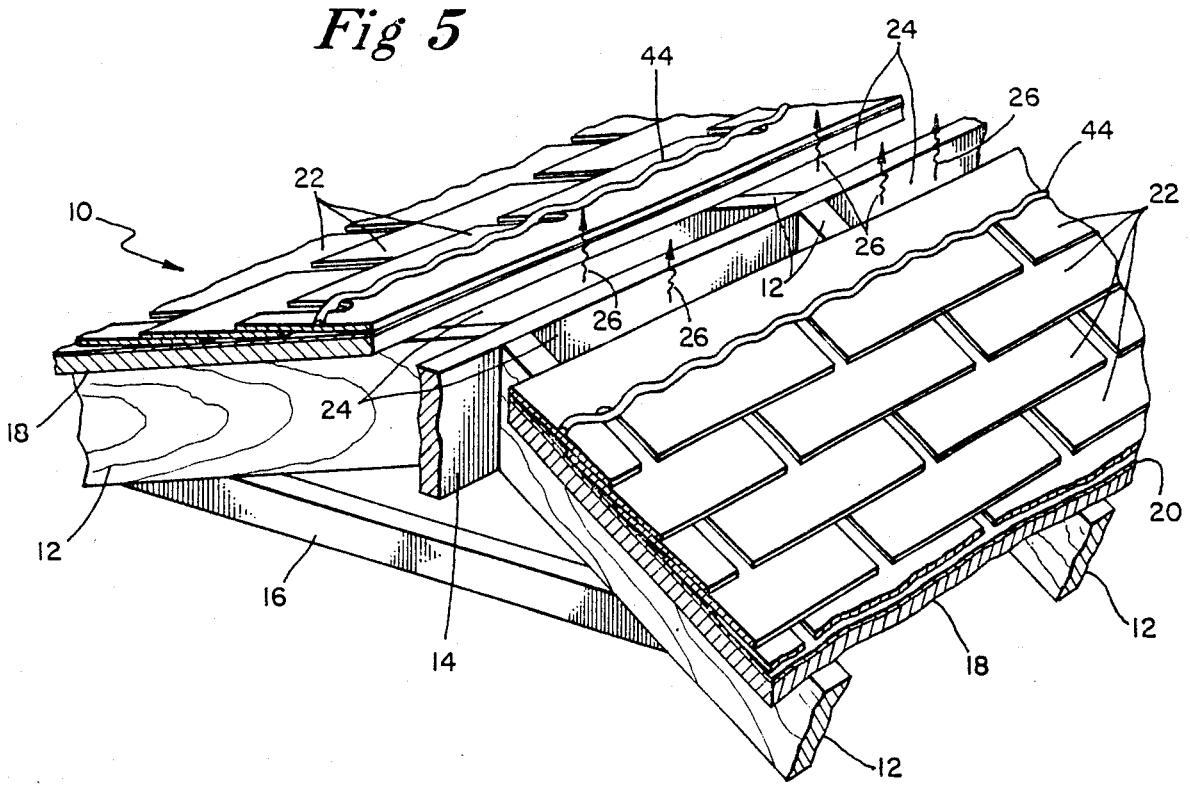
FIG. 5 is a perspective view showing the adhesive beads that have been applied prior to the securement of my ventilator in place.
Figure 6:
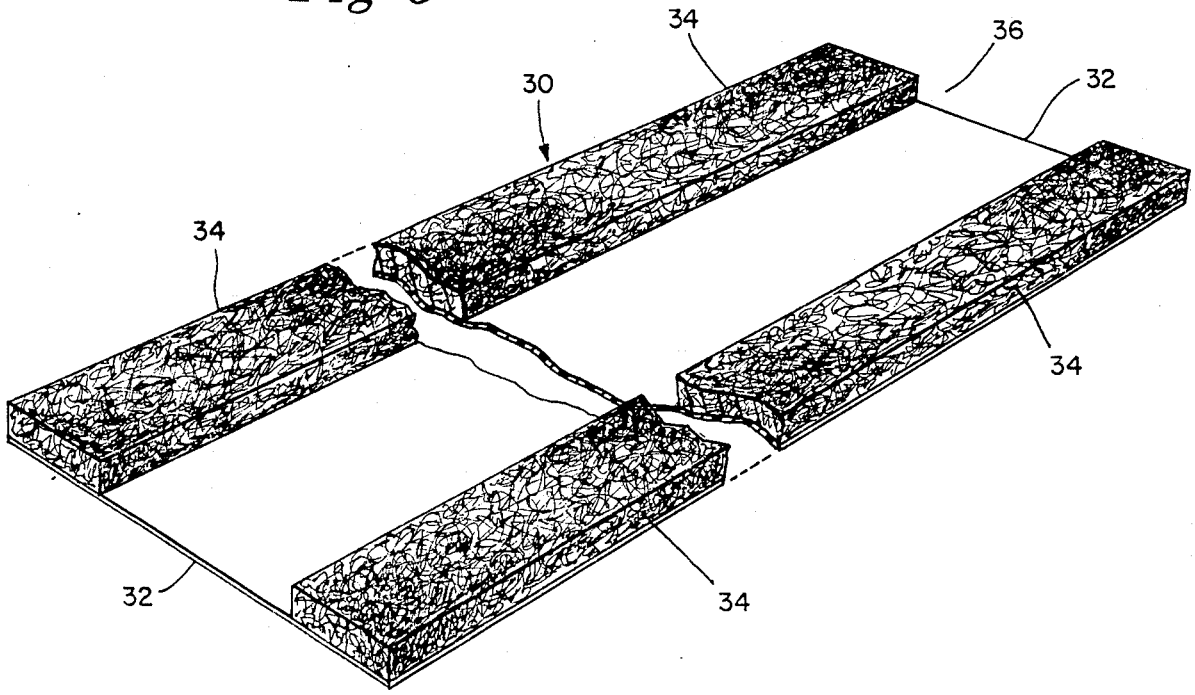
FIG. 6 is a perspective view of a single ventilator section, the ventilator section having been inverted so as to show to better advantage the two laterally spaced strips that are secured to the membrane.

Inasmuch as my invention lends itself readily to being used without any overlying shingles 40, attention is directed at this time to FIG. 5 where two beads 44 of appropriate adhesive have been extruded onto the top of the shingles 22 before manually pressing down one of the ventilator sections 30. More specifically, the application of the beads 44 enable the roofer to press in place each section 30 and the beads 44 then retain each section 30 in place. It will be appreciated that a suitable color can be imparted to the membrane 32 so as to either blend in or match the various shingles 22. Hence, it is not essential to apply the overlying shingles 40.

Figure 3:
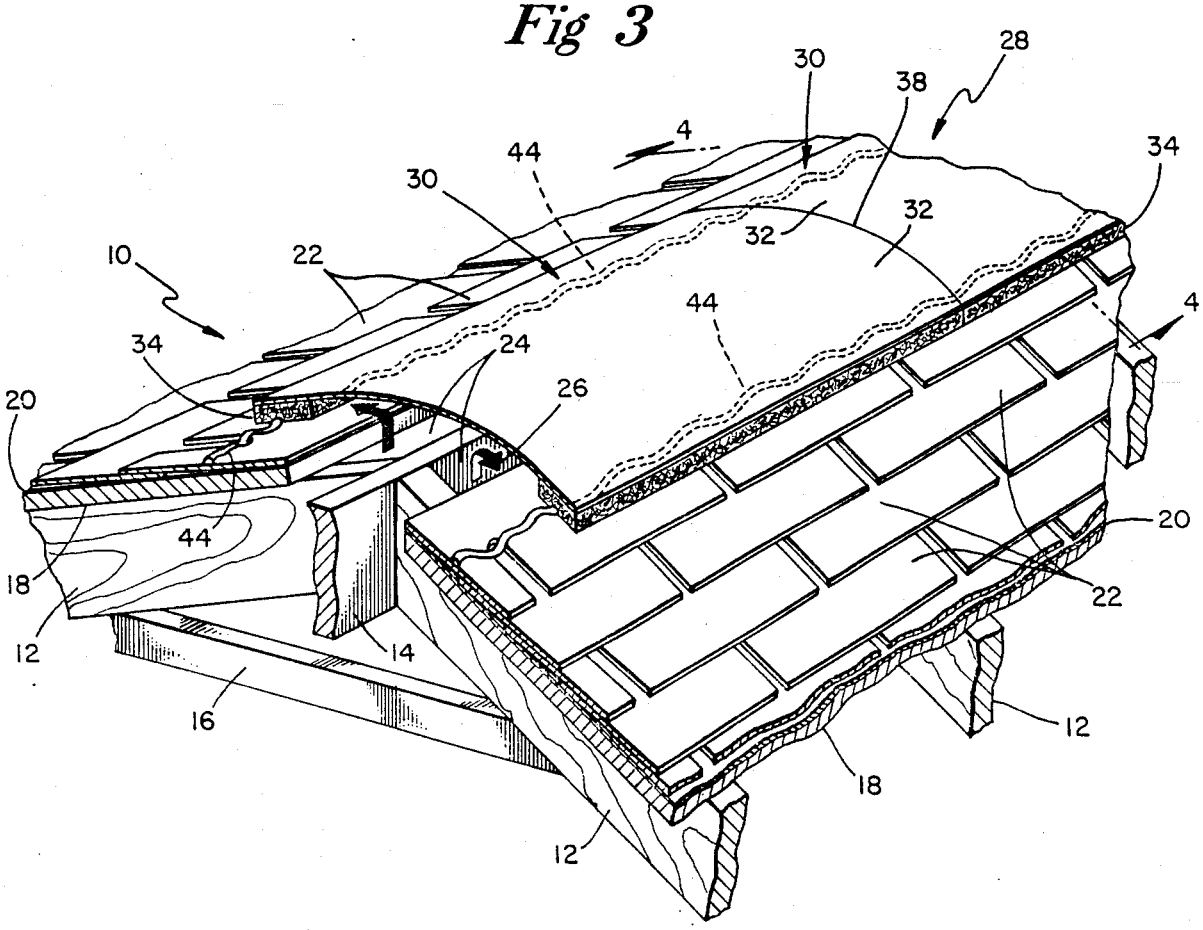
FIG. 3 is a perspective view very much like FIG. 1, but with the overlying shingle omitted, the view illustrating the use of adhesive beads for attaching the ventilator to the roof rather than nails.
Figure 4:
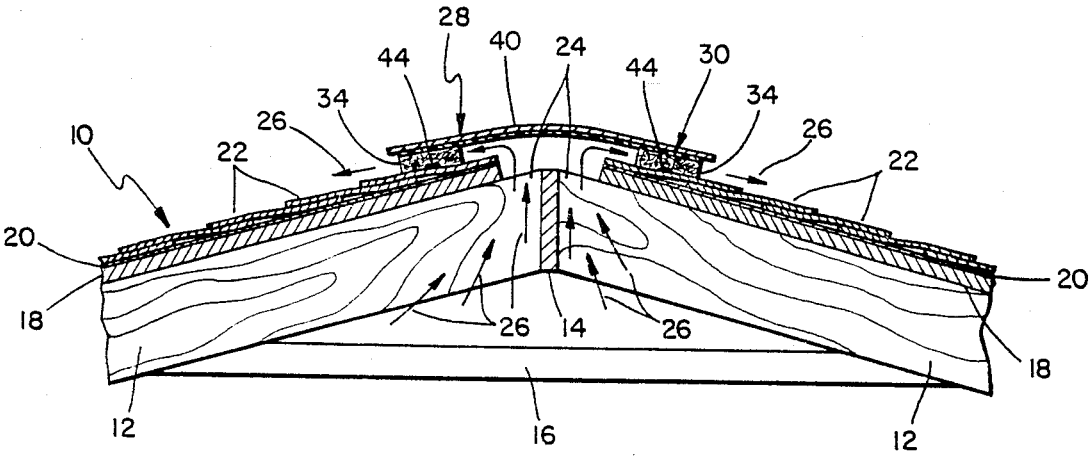
FIG. 4 is a sectional view taken in the direction of 4—4 that illustrates to better advantage the adhesive beads employed in securing my ventilator in place.

Although adhesive beads 44 have been used in attaching the section 30 as far as FIGS. 3–5 are concerned, it will be understood that nails can be driven downwardly through the plastic membrane 32, leaving exposed nail heads as in FIGS. 1 and 2. It is just that there is an advantage at times in not using any nails, so it is important to recognize that my invention avoids the need for any nailing when circumstances so dictate or if it is just desirable to not use nails.

A far as the effectiveness of my roof ventilator 28 is concerned, it should be appreciated that the interconnecting cells or pores provide an ample avenue for the virtual free-flow of air upwardly through the opening 24 and then horizontally outwardly through the two strips 34, all as indicated by the arrows 26. Obviously, 100% freedom of air flow would be the best goal to achieve, but such an opening would permit the ingress of moisture and insects without any inhibition as far as ingress of these items is concerned. The use of the open cell plastic strips 34 function admirably as far as permitting almost an unrestricted flow of air; in other words, the resistance to airflow is very minimal when utilizing my roof ventilator 28. Stated somewhat differently, there should be an easy outward passage of air from beneath the roof 10, yet there should at the same time be an effective resistance to the entrance of moisture, particularly wind-borne rain and also snow, through the strips 34. It is the presence of what amounts to the very fine interlinked filaments or strands that moisture is inhibited from entering the building from the outside, even when the moisture is wind-driven, for the moisture collects on the various filaments or strands instead of entering the building through the opening 24.

Because of the space labelled 36, the sections 30 actually being channel-shaped, there is a need for blocking the openings that would otherwise exist at the extreme ends of the ventilator 28. This is accomplished with suitably sized end caps. This capability should be readily understood without depicting the situation.

It will be appreciated that the combined length of the sections may not conform to the length of the roof 10. Nonetheless, owing to the fact that the membrane 32, and the strips 34 as well, can be readily severed, there is no problem in cutting off whatever portion of the section 30 that would otherwise overhang an end of the roof 10.

I claim:

1. A roof ventilator section comprising an impervious flexible plastic membrane constituting a flat sheet conformable to different roof pitches, and a pair of laterally-spaced open cell foamed plastic strips secured to one side of said membrane, said strips having a multiplicity of interlinked filaments.

2. A roof ventilator section in accordance with claim 1 in which the open cells constitutes about 95% of the cross section of said strips.

3. A roof ventilator section in accordance with claim 1 in which said plastic membrane has a thickness on the order of 3/16 inch and is of closed cell foamed polypropylene.

4. A roof ventilator section in accordance with claim 3 in which said membrane has a density on the order of three pounds per cubic foot and the density of said strips is on the order of 1.75 pounds per cubic foot.

5. A roof ventilator section in accordance with claim 4 in which said plastic strips are of foamed polyurethane having a thickness on the order of 7/8 inch.

6. In combination, a sloping roof having a vent opening therein, a plurality of ventilator sections secured to said roof, each ventilator section including an impervious flexible plastic membrane, the flexibility of said membrane allowing said membrane to conform readily to the pitch of the sloping roof, and an open cell foamed plastic strip having its upper side secured to the underside of said membrane and its lower side secured to said roof, said strip having a multiplicity of interlinked filaments or strands that are quite slender or skeletal as far as their cross section is concerned to provide a myriad of interconnecting cells or pores so that airflow through each ventilator section can occur only through its open cell strip and in a direction generally parallel to the portion of said membrane overlying said strip and the portion of said roof underlying said strip, whereby moisture collects on the various filaments or strands instead of passing through said vent opening.

7. In combination, a roof having a vent opening therein, a plurality of ventilator sections secured to said roof, each ventilator section including an impervious membrane and a pair of laterally-spaced open cell foamed plastic strips having their upper sides secured to the underside of said membrane and their lower sides secured to said roof, said strip having a multiplicity of interlinked filaments or strands that are quite slender or skeletal as far as their cross section is concerned to provide a myriad of interconnecting cells or pores, whereby moisture collects on the various filaments or strands instead of passing through said vent opening.

8. The combination of claim 8 in which said ventilator sections are nailed to said roof.

9. The combination of claim 8 in which said ventilator sections are adhesively secured to said roof.

* * * * *